US009554650B1

(12) United States Patent
Hubbard, Sr. et al.

(10) Patent No.: US 9,554,650 B1
(45) Date of Patent: Jan. 31, 2017

(54) WEIGHT DISTRIBUTING CHAIR STABILIZING DEVICE

(71) Applicants: Roland C. Hubbard, Sr., Perland, TX (US); Craig D. Hubbard, Houston, TX (US); Antonio K. Hubbard, Pearland, TX (US)

(72) Inventors: Roland C. Hubbard, Sr., Perland, TX (US); Craig D. Hubbard, Houston, TX (US); Antonio K. Hubbard, Pearland, TX (US)

( * ) Notice: Subject to any disclaimer, the term of this patent is extended or adjusted under 35 U.S.C. 154(b) by 0 days.

(21) Appl. No.: 14/959,582

(22) Filed: Dec. 4, 2015

(51) Int. Cl.

| | |
|---|---|
| ***A47B 91/12*** | (2006.01) |
| ***A47C 7/00*** | (2006.01) |
| ***A47C 7/62*** | (2006.01) |
| ***A47B 91/06*** | (2006.01) |

(52) U.S. Cl.
CPC ..... *A47B 91/12* (2013.01); *A47B 91/06* (2013.01); *A47C 7/002* (2013.01); *A47C 7/62* (2013.01)

(58) Field of Classification Search
CPC ..... A47B 91/066; A47B 91/06; A47B 91/12; A47C 7/6244; A47C 7/62; A47C 1/14; A47C 7/002
USPC ..... 248/188.9; 297/463.1; 16/42 R
See application file for complete search history.

(56) References Cited

U.S. PATENT DOCUMENTS

| | | | | |
|---|---|---|---|---|
| 1,554,327 | A * | 9/1925 | Boberg | A47B 91/12 16/42 R |
| 3,254,362 | A * | 6/1966 | Rasor | A47B 91/06 16/42 R |
| 4,029,278 | A | 6/1977 | Napoleon | |
| 5,040,758 | A | 8/1991 | Giovannetti | |
| 5,042,764 | A | 8/1991 | Carpinella et al. | |
| 5,141,076 | A * | 8/1992 | Joyce | E06C 7/46 182/108 |
| 5,494,333 | A | 2/1996 | Wilson | |
| 5,513,900 | A | 5/1996 | Iglesias | |
| 5,536,068 | A | 7/1996 | Valentor et al. | |
| 5,725,188 | A | 3/1998 | Monteiro, Jr. | |
| 6,728,991 | B2 * | 5/2004 | Lai | B60B 33/0002 16/19 |
| 6,905,172 | B1 * | 6/2005 | Barnett | A47C 7/002 248/188.5 |
| 7,380,879 | B2 | 6/2008 | Fletcher et al. | |
| 7,770,853 | B2 * | 8/2010 | Shiffler | A47B 91/06 248/188.9 |
| 7,774,950 | B2 | 8/2010 | Lasley | |

(Continued)

*Primary Examiner* — Milton Nelson, Jr.
(74) *Attorney, Agent, or Firm* — Dale J. Ream

(57) ABSTRACT

A weight distributing chair stabilizing device for use in stabilizing a chair having at least a pair of spaced apart support members includes a plurality of stabilizing members, each having a planar bottom side configured to engage a ground surface and an opposed top side configured to receive a respective support member of the chair. The top side of each stabilizing member defines a linear channel extending between opposed peripheral edges of the top side, the channel being configured to selectively receive a respective chair support member therein. The stabilizing members may be a set of four circular discs although stabilizing members having other shape configurations would also work. When equally spaced apart on a ground surface, the support members of the chair may be positioned thereon and, as a result, the weight of the chair is equally distributed so as to stabilize the chair even on soft ground.

11 Claims, 6 Drawing Sheets

(56) References Cited

U.S. PATENT DOCUMENTS

2007/0170760 A1 7/2007 Peterson

* cited by examiner

WEIGHT DISTRIBUTING CHAIR STABILIZING DEVICE

BACKGROUND OF THE INVENTION

This invention relates generally to chair leveling and stabilizing devices and, more particularly, to a multi-part chair stabilizing device that evenly distributes weight imparted upon a ground surface.

Outdoor recreation activities are frequently engaged in while seated in a lawn chair. A lawn chair is a form of outdoor personal seating furniture having a seating surface with legs extending downwardly, the legs most commonly being in the form of four individual legs or front and rear U-shaped legs. In either case, but especially in the case of individual legs having pointed or small-diameter free ends, the leg ends are prone to sinking into the ground when the ground is wet, includes soft soil, or has a vegetation layer that is otherwise unstable relative to the legs of the law chair.

Various devices have been proposed in the art for leveling chairs on uneven ground or otherwise stabilizing a lawn chair from undesirable and unintended movement. Although presumably effective for their intended purpose, there has not previously been a reasonable solution to the problem of the legs of a lawn chair sinking into a soft portion of ground—especially when the full weight of a person is seated in and bearing downwardly on the legs of the chair.

Therefore, it would be desirable to have a weight distributing chair stabilizing device that may be positioned on the ground so as to receive the legs of a chair thereon and evenly distribute the weight of the chair and person sitting in it. Further, it would be desirable to have a weight distributing chair stabilizing device that resists or prevents the legs of a lawn chair from sinking into soft soil. In addition, it would be desirable to have a weight distributing chair stabilizing device in which a top surface defines a linear channel and recess configured to receive a lower portion or end of a chair in a secure nested engagement.

SUMMARY OF THE INVENTION

A weight distributing chair stabilizing device according to the present invention for use in stabilizing a chair atop soft soil having at least a pair of spaced apart support members includes a plurality of stabilizing members, each stabilizing member including a bottom side having a planar surface configured to engage a ground surface and a top side opposite the bottom side and configured to receive a respective support member of the chair. The top side of each stabilizing member defines a linear channel extending opposed peripheral edges of the top side, the channel being configured to selectively receive a respective chair support member therein. The stabilizing members may be a set of four circular discs although stabilizing members having other shape configurations would also work. When equally spaced apart on a ground surface, the support members of the chair may be positioned thereon and, as a result, the weight of the chair is equally distributed so as to stabilize the chair even on soft ground.

Therefore, a general object of this invention is to provide a chair stabilizing device having a plurality of stabilizing members that may be spaced apart on the ground and that may receive respective leg support members of a chair thereon for an equal weight distribution of the chair thereon.

Another object of this invention is to provide a chair stabilizing device, as aforesaid, in which each stabilizing member defines a linear channel configured to receive a lower portion or free end of a respective chair supporting member in a stable friction fit engagement.

Yet another object of this invention is to provide a chair stabilizing device, as aforesaid, in which each stabilizing member may be easily rotated and oriented to receive different configurations of chair supporting members.

A further object of this invention is to provide a chair stabilizing device, as aforesaid, that is easy to transport and position for use in stabilizing a chair in an outdoor environment.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
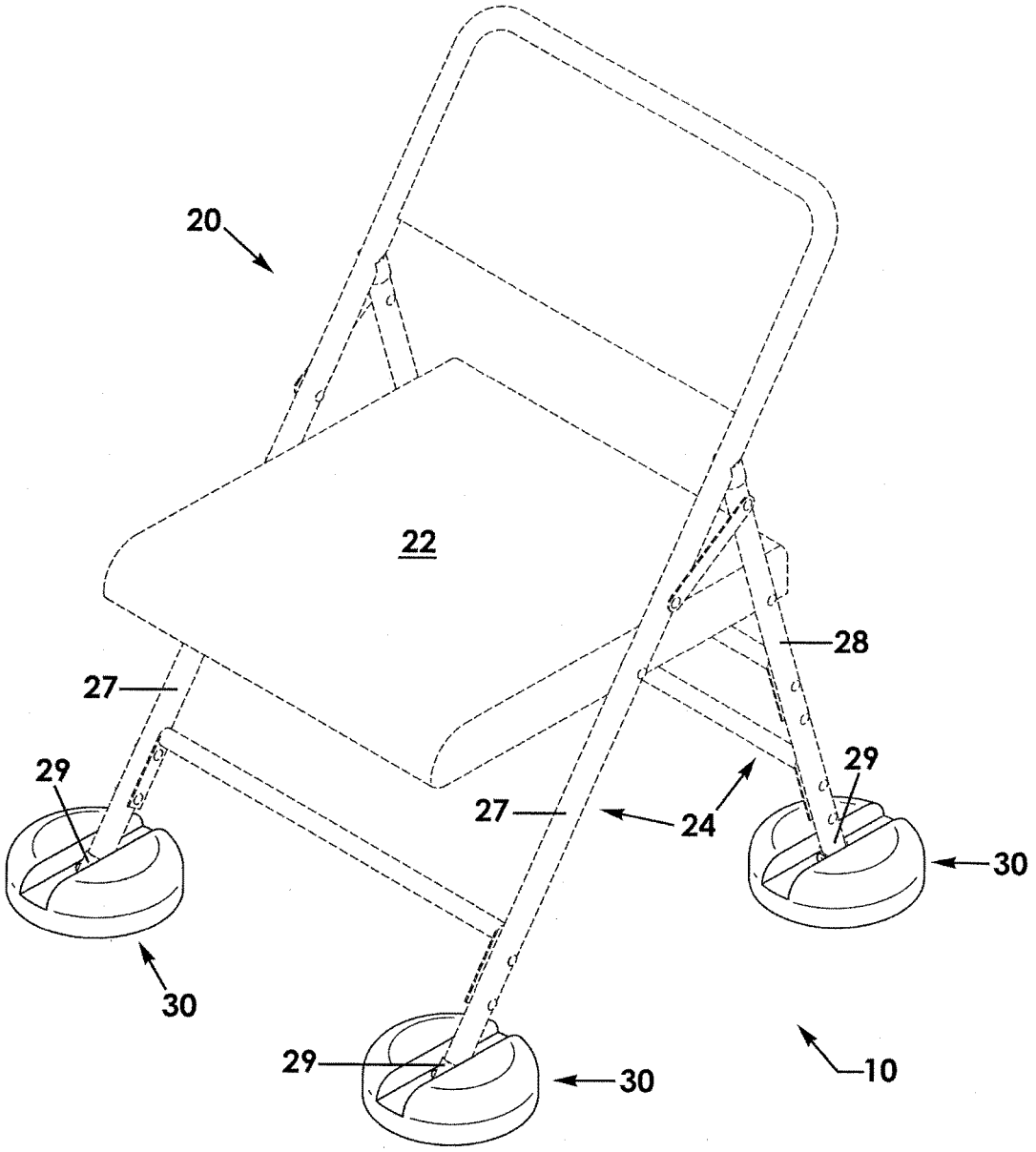
FIG. 1 is a perspective view of a chair stabilizing device according to a preferred embodiment of the present invention illustrated in use with a four-legged chair.
Figure 2:
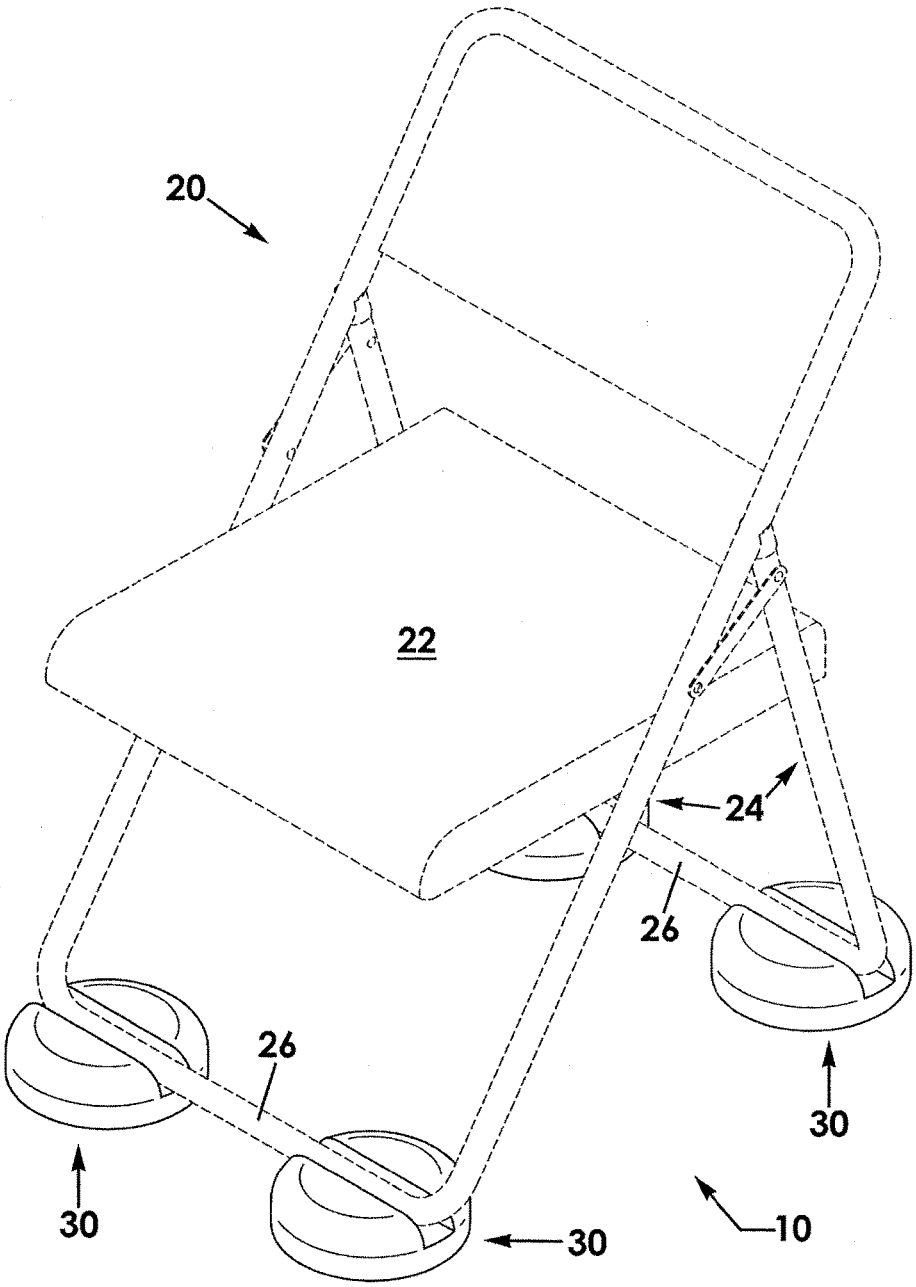
FIG. 2 is another perspective view of the chair stabilizing device in use with a chair having front and rear U-shaped legs.
Figure 3:
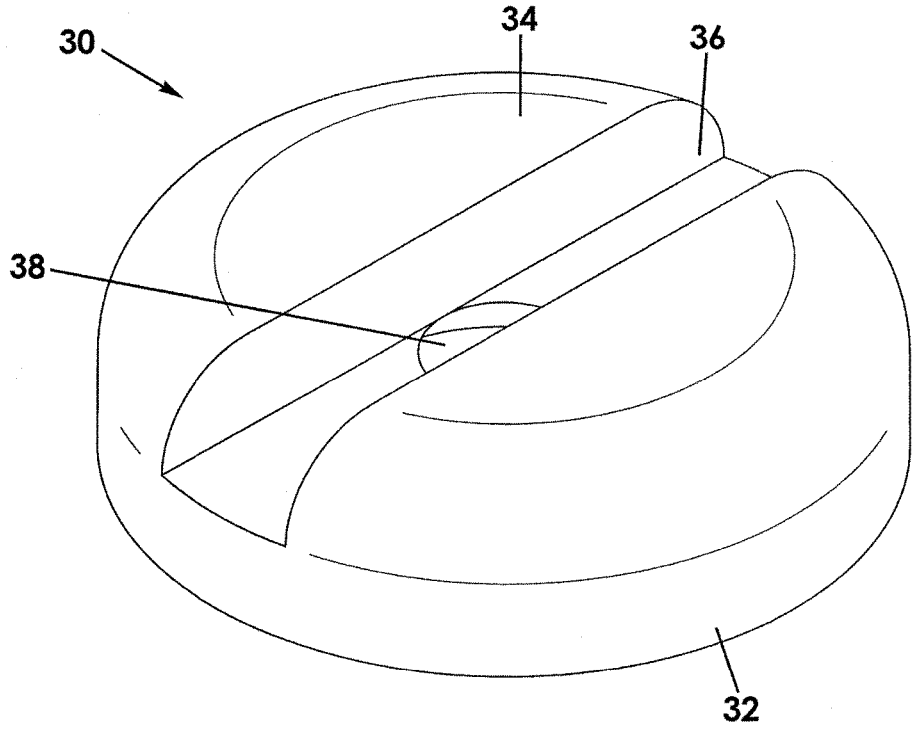
FIG. 3 is a perspective view of a single stabilizing member with the chair removed.

A chair stabilizing device according to a preferred embodiment of the present invention will now be described with reference to FIGS. 1 to 6 of the accompanying drawings. The chair stabilizing device 10 includes a plurality of stabilizing members 30 configured to receive and support at least a pair of support members 24 thereon. For instance, the plurality of stabilizing members 30 may be used to stabilize a chair having a pair of support members 24, i.e. a front leg member and a rear leg member, each leg member having a generally U-shaped configuration and having a lower portion 26 that has a horizontal and linear configuration that normally rests upon the ground surface and supports a seating surface 22 (FIG. 2). In another instance, the plurality of stabilizing members 30 may be used to stabilize a chair having a plurality of leg members, i.e. two front leg members 27 and two rear leg members 28 extending downwardly from the seating surface 22 and each having a terminal or free end 29 that may be nested atop a respective stabilizing member 30 (FIG. 1), as will be described later.

Each stabilizing member 30 includes a bottom side 32 having a planar or flat surface that is configured to engage a ground surface. In an embodiment, the bottom side 32 may include a grip or non-slip surface that will naturally resist sliding. Each stabilizing member 30 may include a top side 34 opposite the bottom side 32, the top side 34 being configured to receive a respective free end 29 or lower portion 26 of a support member 24 of the chair 20.

Preferably, each stabilizing member 30 may be in the form of a disc having a circular configuration although other shape considerations are also possible. In any case, however, the bottom side 32 of each stabilizing member 30 includes a width dimension that is at least twice as large as a width dimension of a respective lower portion 26 or free end 29 of a respective support member 24 of the chair 20. More particularly, a diameter of a disc shaped stabilizing member 30 is at least twice a diameter of a free end 29 of a support leg of a chair. The diameter the disc-shaped stabilizing member 30 is greater than a width of the lower portion 26 of a corresponding chair 20.

The plurality of stabilizing members 30 may, more particularly, be a set of four circular discs. In use, the set of discs may be spaced apart on the ground in a pattern so that the four chair leg free ends 29 or opposed ends of respective lower portions 26 of a chair's support members may be supported thereon. When properly spaced apart so as to receive four spaced apart downward weight points of a chair, the weight of the chair and a person sitting therein is evenly distributed onto the four circular discs.

The top side 34 of a stabilizing member 30 defines a channel 36 having a linear configuration that extends completely between opposed peripheral edges. Preferably, the channel 36 defines a width that is complementary to a width/diameter of a respective support member 24 of a chair. The channel 36 is configured to receive, for instance, the lower portion 26 of a U-shaped support member 24 of a chair in a nested configuration. In an embodiment, the channel 36 and lower portion 26 of the chair may have substantially the same width dimensions so as to be coupled in a stable friction fit relationship, i.e. to the stabilizing member 30 and support member 24 remain coupled together even if the chair is lifted and moved.

The top side 34 of each stabilizing member 30 further defines a recess 38, cutout, or depression situated within the channel 36, the recess 38 being centered between opposed peripheral edges of the top side 34 so as to be balanced when supporting a chair. The recess 38 is specifically configured to receive a free end 29 of a four-legged chair in a nested and stable relationship. In an embodiment, the recess 38 and free end 29 of a chair support member 24 may have substantially the same diameter so as to be coupled in a stable friction fit relationship, i.e. to the stabilizing member 30 and support member 24 remain coupled together even if the chair is lifted and moved.

Figure 4A:
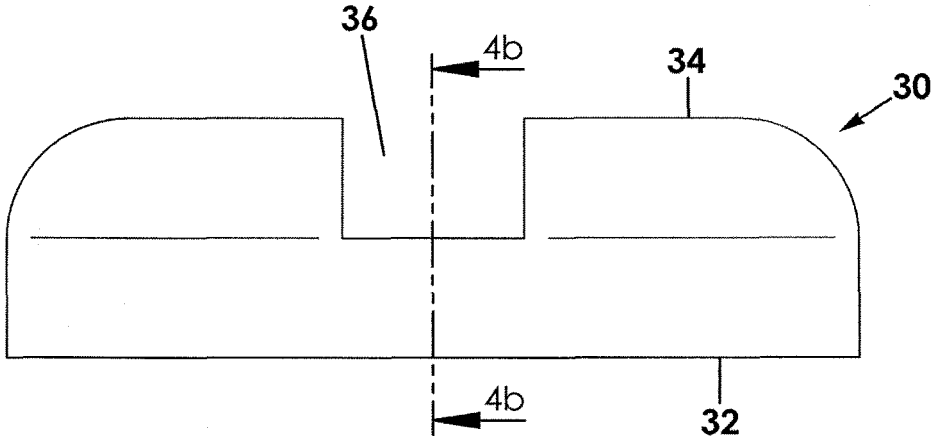
FIG. 4*a* is a side view of the stabilizing member as in FIG. 3.
Figure 4B:
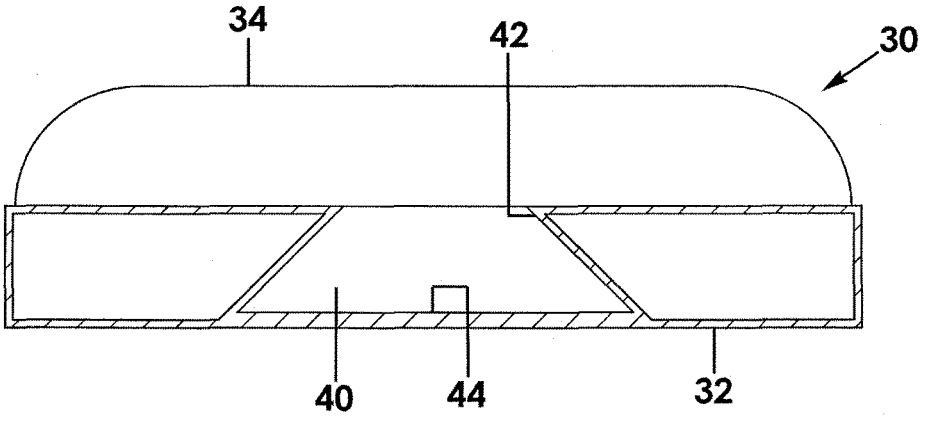
FIG. 4*b* is a sectional view taken along line 4*b*-4*b* of FIG. 4*a;*
Figure 5A:
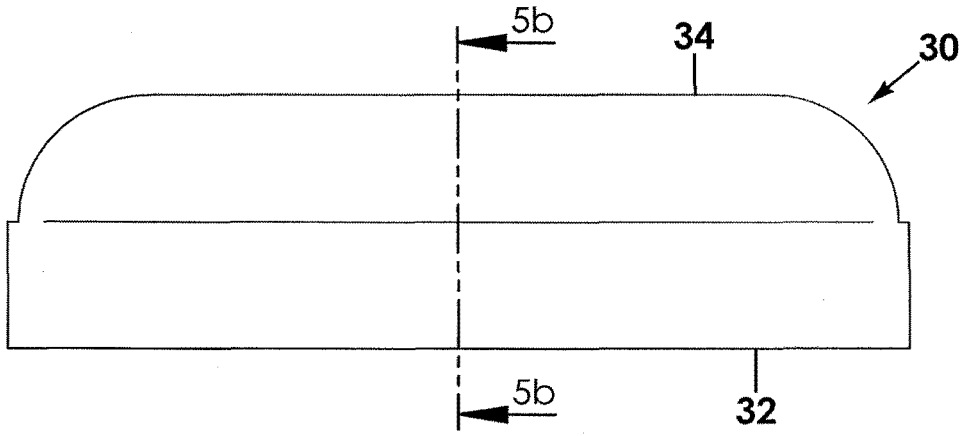
FIG. 5*a* is a side view from another angle of the stabilizing member as in FIG. 4*a;*
Figure 5B:
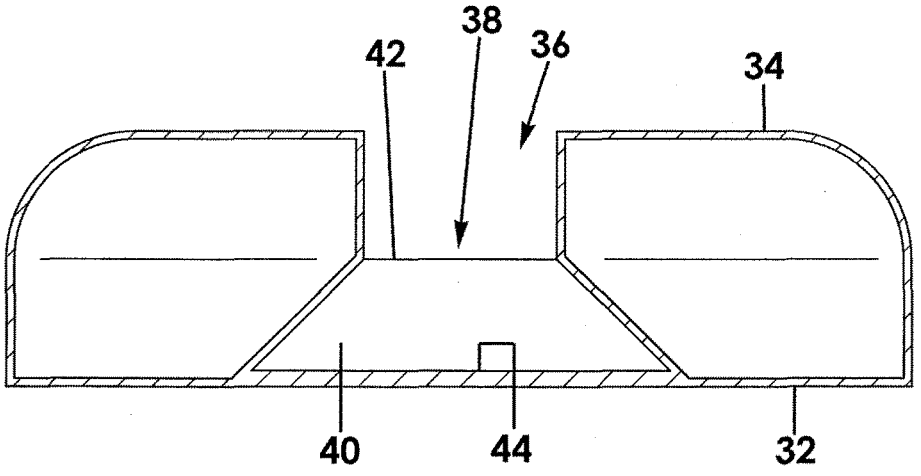
FIG. 5*b* is a section view taken along line 5*b*-5*b* of FIG. 5*a*.
Figure 6:
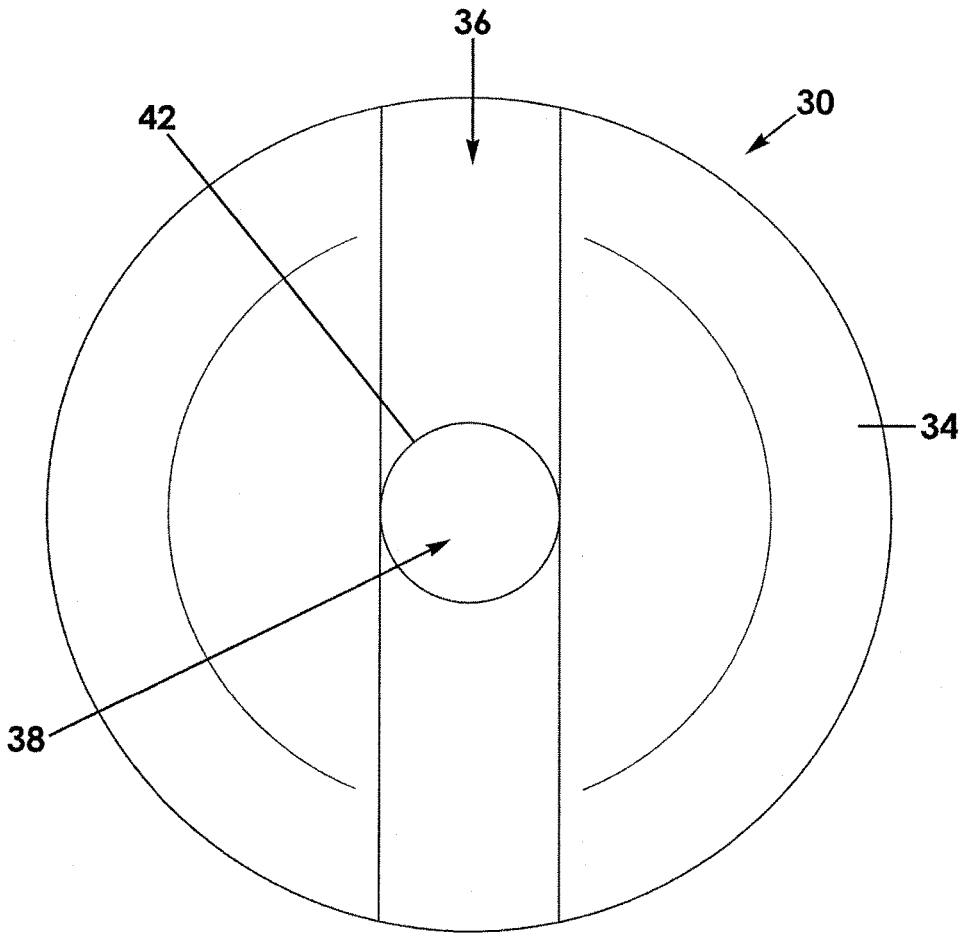
FIG. 6 is a top view of the stabilizing member as in FIG. 3.

The recess 38 defines an interior area 40 and an open upper end 42 that provides access to the interior area 40. The open upper end 42 is in communication with the channel 36 itself. The recess 38 has a closed lower end 44 which may also be the bottom side 32 of the stabilizing member 30 (FIG. 4*b*). Further, the recess 38 may define a diameter adjacent the open upper end 42 that it smaller than a diameter adjacent the closed lower end 44, wherein a free end 29 of a chair support member 24 inserted at an angle into the interior area 40 is able to extend snugly all the way to the closed lower end 44.

In another aspect, the plurality of stabilizing members 30 may be coupled to or have a unitary construction with the free ends 29 or lower portion 26 of a chair. More particularly, the chair stabilizing device 10 includes a chair 20 having a seating surface 22 and at least a pair of support members 24 extending downwardly from the seating surface 22 (FIGS. 1 and 2). In an embodiment, a plurality of stabilizing members 30 may be removably coupled to lower ends of respective support members 24 in a friction fit manner, as described above. In another embodiment, the stabilizing members 30 may be fixedly coupled to lower ends of the respective support members 24.

In use, the plurality of stabilizing members 30 may be positioned on a ground surface at a location where a user desires to position and then sit in a lawn chair, either of the type having four spaced apart legs (2 rear and 2 front) or having front and rear U-shaped legs. The stabilizing members 30 are generally positioned at the corners of an imaginary square such that when the chair is positioned thereon, the weight of the chair and the person seated thereon is evenly distributed throughout the stabilizing members. Accordingly, the stabilizing device 10 enables a chair to be stabilized on soft (e.g. muddy) ground such as wet soil or grass. With each stabilizing member 30 being dimensioned at least twice the width or diameter of a chair leg end, the chair is stabilized not on soft soil but also firm ground that is uneven or unlevel.

It is understood that while certain forms of this invention have been illustrated and described, it is not limited thereto except insofar as such limitations are included in the following claims and allowable functional equivalents thereof.

The invention claimed is:

1. A chair stabilizing device capable of selectively stabilizing one of a first chair having a pair of spaced apart U-shaped support members and a second chair having four spaced apart leg end support members, said chair stabilizing device, comprising:

a plurality of stabilizing members, each stabilizing member including a bottom side having a planar surface configured to engage a ground surface and a top side opposite said bottom side having a configuration capable of receiving a respective support member of the first chair;

wherein respective top sides of respective stabilizing members define a channel extending completely between opposed peripheral edges of said top side such that opposed ends of said channel are open adjacent said opposed peripheral edges, said channel configured to receive the respective support member therein;

wherein said channel has a linear configuration for selectively receiving a respective support member of the first chair in a nested relationship;

wherein each top side of said respective stabilizing members defines a circular recess situated in said channel for receiving a respective support member of the second chair.

2. The chair stabilizing device as in claim 1, wherein said recess is centered between said opposed peripheral edges of said stabilizing member.

3. The chair stabilizing device as in claim 1, wherein:

said recess defines an interior area intermediate an open upper end providing access to said interior area and a closed lower end;

said upper end has a diameter smaller than a diameter of said closed lower end;

a continuous recess wall extends at an outward angle between said open upper end and said closed lower end.

4. The chair stabilizing device as in claim 1, wherein said respective stabilizing member is a disc having a circular configuration.

5. The chair stabilizing device as in claim 4, wherein said plurality of stabilizing members includes four discs configured to receive a distributed weight of the chair when equally spaced apart to receive respective support members of the chair.

6. A self-stabilizing chair apparatus, comprising:

a seating surface;

at least a pair of spaced apart support members extending downwardly from said seating surface;

a plurality of stabilizing members, each stabilizing member including a bottom side having a planar surface configured to engage a ground surface and a top side opposite said bottom side and configured to receive a respective support member;

wherein respective top sides of respective stabilizing members define a channel extending completely between opposed peripheral edges of said top side such that opposed ends of said channel are open adjacent said opposed peripheral edges, said channel configured to receive the respective support member therein;

wherein each top side of said respective stabilizing members defines a circular recess situated in said channel for receiving a free end of a respective support member;

wherein:

said recess defines an interior area intermediate an open upper end providing access to said interior area and a closed lower end;

said upper end has a diameter smaller than a diameter of said closed lower end.

7. The chair stabilizing device as in claim 6, wherein said channel has a linear configuration for selectively receiving a respective support member of the chair having a linear configuration.

8. The chair stabilizing device as in claim 6, wherein respective bottom sides of respective stabilizing members include a width dimension that is at least twice as large as a width dimension of lower ends of said at least a pair of spaced apart support members.

9. The chair stabilizing device as in claim 8, wherein said channel has a linear configuration for selectively receiving a respective support member of the chair having a linear configuration.

10. The chair stabilizing device as in claim 9, wherein each stabilizing member is a disc having a circular configuration.

11. The chair stabilizing device as in claim 10, wherein said plurality of stabilizing members includes four discs configured to collectively receive a distributed weight of the seating surface when equally spaced apart to receive respective support members.

* * * * *